US008860339B2

(12) United States Patent
Hozumi

(10) Patent No.: US 8,860,339 B2
(45) Date of Patent: Oct. 14, 2014

(54) TRIGGER SWITCH CIRCUIT AND ELECTRIC INSTRUMENT

(75) Inventor: Akihiro Hozumi, Okayama (JP)

(73) Assignee: Omron Corporation, Kyoto (JP)

( * ) Notice: Subject to any disclaimer, the term of this patent is extended or adjusted under 35 U.S.C. 154(b) by 101 days.

(21) Appl. No.: 13/476,820

(22) Filed: May 21, 2012

(65) Prior Publication Data

US 2012/0327637 A1 Dec. 27, 2012

(30) Foreign Application Priority Data

May 31, 2011 (JP) ..... 2011-122652

(51) Int. Cl.

| | |
|---|---|
| ***F21V 33/00*** | (2006.01) |
| ***H01H 9/54*** | (2006.01) |
| ***H01H 13/20*** | (2006.01) |
| ***B25F 5/02*** | (2006.01) |

(52) U.S. Cl.

CPC ..... *H01H 9/541* (2013.01); *H01H 13/20* (2013.01); *B25F 5/021* (2013.01)

USPC ..... 318/268; 318/400.3

(58) Field of Classification Search

CPC ..... H01H 9/541

USPC ..... 200/18, 9, 6 B, 437, 522; 318/268, 318/400.3; 227/8, 129

See application file for complete search history.

(56) References Cited

U.S. PATENT DOCUMENTS

| | | | | |
|---|---|---|---|---|
| 6,262,380 | B1 * | 7/2001 | Sasaki et al. | 200/6 BB |
| 2008/0069548 | A1 * | 3/2008 | Miyaura et al. | 388/837 |
| 2010/0237124 | A1 * | 9/2010 | Shima et al. | 227/8 |

* cited by examiner

*Primary Examiner* — Elmito Breval

(74) *Attorney, Agent, or Firm* — Foley & Lardner LLP

(57) ABSTRACT

Embodiments of a trigger switch circuit are described. In some embodiments of the trigger switch circuit wasteful power consumption is suppressed without increasing the number of components by providing a changeover switch. In some embodiments, a trigger switch circuit operates in conjunction with a trigger of an electric instrument and comprises a main switch, a sliding switch, a light-emission control unit, and a rotation control unit. In some embodiments, when the trigger is in a first position, the sliding switch is connected to one of the fixed contact points, and electric power is fed to the light-emission control unit without interposing the main switch to emit light in an LED. When the trigger is in a second position, the main switch is turned on to feed the electric power into the trigger switch circuit.

9 Claims, 3 Drawing Sheets

TRIGGER SWITCH CIRCUIT AND ELECTRIC INSTRUMENT

RELATED APPLICATIONS

This application claims priority to Japanese Patent Application No. 2011-122652, filed May 31, 2011, which is incorporated herein by reference in its entirety.

BACKGROUND OF THE TECHNOLOGY

The present application relates to a trigger switch circuit mounted on an electric instrument or appliance, such as an electric drill.

Electrical appliances or electrical instruments commonly have a trigger switch circuit attached to the trigger, and the trigger switch is used primarily to turn on or off operation of a motor in the electrical appliance or instrument. Recently, in order to increase convenience for a user, a trigger switch device that turns on or off a light-emitting element for illumination when actuated has also been considered, and has been described, for example, in United States Patent Publication No. 2006/0186102 (published on Aug. 24, 2006), which is incorporated herein by reference in its entirety.

In conventional electric instruments which use a trigger switch device and comprise a light-emitting element, when the electric instrument is used, before operating the motor, surroundings may be illuminated and checked. However, in the conventional trigger switch circuit when the light-emitting element 15 emits light, electric power is also supplied to an integrated circuit IC made of a control unit and an operational amplifier, which controls the rotational speed of the motor. Thus, in the case where illumination is performed without operating the motor, electric power is also supplied to the circuits related to the motor, causing wasteful power consumption.

In order to avoid this problem, a switch may be newly provided to turn on and off the supply of electric power to the integrated circuit IC, however, this would increase the number of components in the trigger device.

SUMMARY OF CERTAIN INVENTIVE ASPECTS

Inventive aspects disclosed herein include a trigger switch circuit in an electric instrument, comprising a trigger having one or more positions, a power switch that turns on/off a supply of electric power from a power supply in conjunction with the trigger, a light-emission circuit comprising a light-emitting element, a motor connected to a motor control circuit, a changeover switch operably coupled to the trigger, the changeover switch configured to sequentially switch contact between one or more contact points in conjunction with operation of the trigger.

In some embodiments, the trigger switch circuit comprises a first contact point that supplies the electric power from the power supply to the light-emission circuit without interposing the power switch and a second contact point connected the motor control circuit.

In some embodiments, the trigger switch circuit is configured such that when the trigger is at an initial position, the power switch is off, and the changeover switch is not connected to either the first or second contact point, when the trigger moves from the initial position to a first position, the changeover switch moves and is connected to the first contact point, when the trigger moves from the first position to a second position, the power switch is turned on, and when the trigger moves beyond the second position to a third position, the changeover switch moves, switches connection from the first contact point to the second contact point.

In some embodiments, the first contact point of the changeover switch stops operation of the motor control circuit.

In some embodiments, the motor control circuit comprises a rotation control unit configured to control average electric power supplied to the motor, and wherein the second contact point of the changeover switch is configured to operate the motor control circuit, so that as the trigger moves from the third position to a fourth position, the average electric power supplied to the motor is increased.

In some embodiments, the changeover switch further comprises a third contact point that operates the motor control circuit so as to maximize the average electric power supplied to the motor, wherein the changeover switch is configured to make contact with the third contact point as the trigger moves from the third position to the fourth position.

In some embodiments the light-emission circuit further comprises an afterglow capacitor that is charged when the electric power from the power supply is supplied, and is discharged to the light-emitting element when the supply of electric power from the power supply to the light-emission circuit is stopped.

Inventive aspects described herein include an electric instrument comprising a motor powered by a power supply, a motor control unit configured to control speed of the motor, a light-emitting element, and a trigger switch device that controls drive of the motor and light emission of the light-emitting element in conjunction with a trigger, wherein the trigger switch device comprises a first contact point electrically connected to the light emitting element and the power supply, a second contact point electrically connected to the motor control unit, wherein the trigger switch device is configured to move such that the trigger switch device makes contact with only one of the first contact point or the second contact point at a time.

Inventive aspects described herein include a method of operating a trigger switch device comprising providing the trigger switch circuit, moving the trigger from a first position to a second position, thereby operating the changeover switch to cause illumination the light emitting element and maintain the motor circuit de-energized, moving the trigger from a second position to a third position, thereby further operating the changeover switch to cause energization of the motor circuit, initiate operation of the motor and maintain illumination of the light emitting element.

In some embodiments, the method further comprising moving the trigger from a second position to a third position, thereby operating the changeover switch to cause motor speed to increase and to maintain illumination of the light emitting element.

DETAILED DESCRIPTION OF CERTAIN INVENTIVE EMBODIMENTS

Certain embodiments in accordance with the present invention will now be described, by way of example only, and with reference to the drawings briefly described above. By way of example, the electric instruments described herein may include electric tools such as an electric drill, and domestic electric appliances such as a dryer. The present embodiments are not limited to these examples, and may be applied to any electric instrument which comprises a motor, a trigger switch device, and a light-emitting element.

Figure 1:
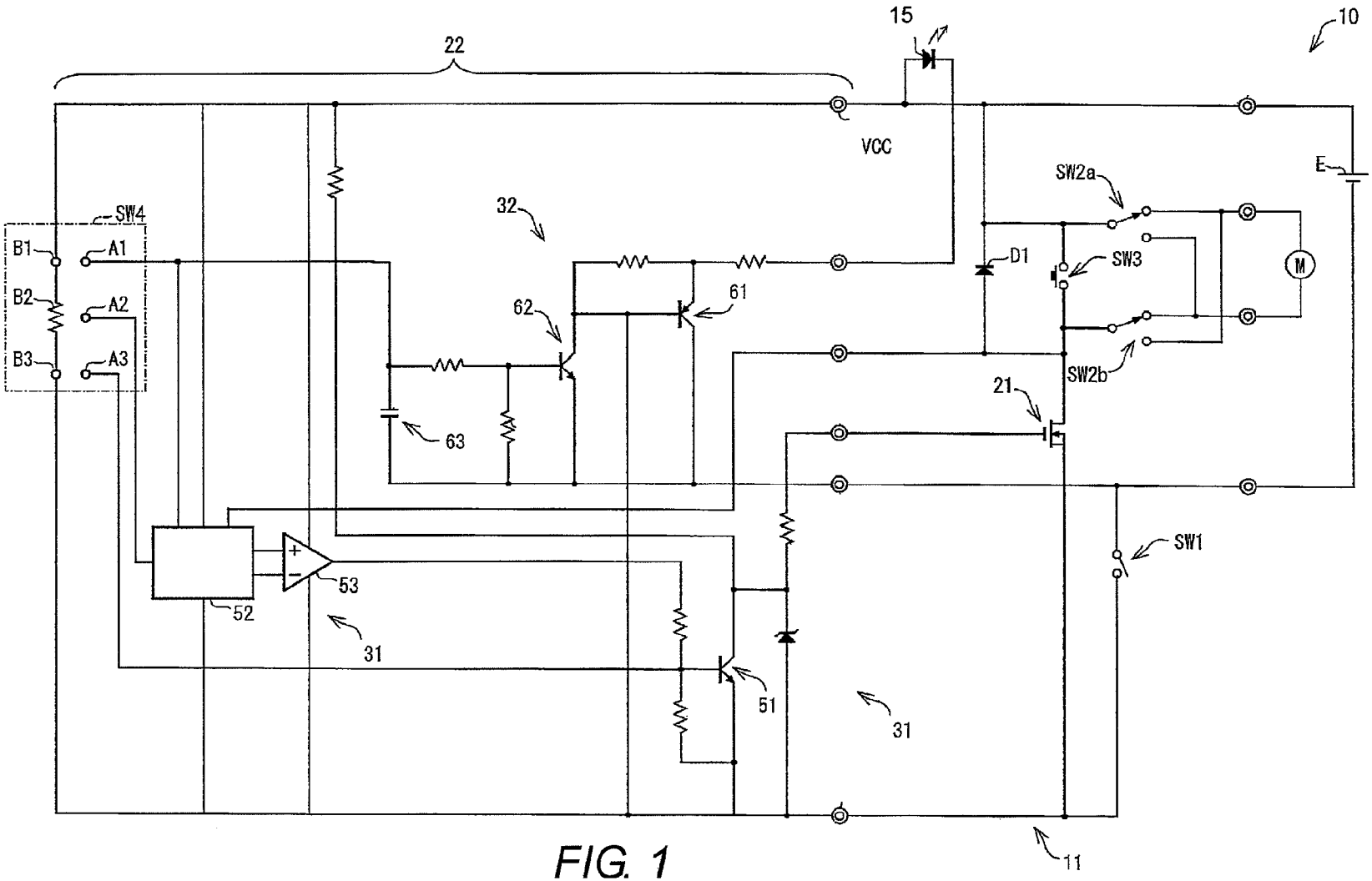
FIG. 1 depicts an embodiment of a circuit diagram of an electric instrument comprising a trigger switch circuit.
Figure 2A:
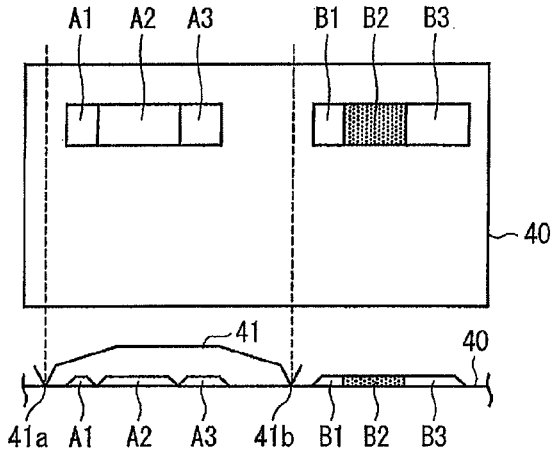
FIGS. 2A to 2C depict a plan view and a cross-sectional view showing embodiments of the structure of a sliding switch in the trigger switch circuit.
Figure 2B:
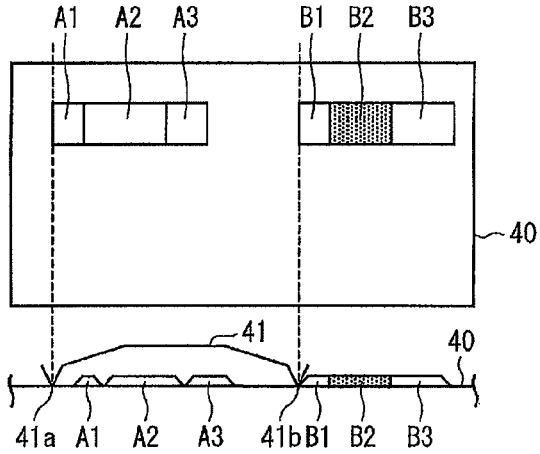
Figure 2C:
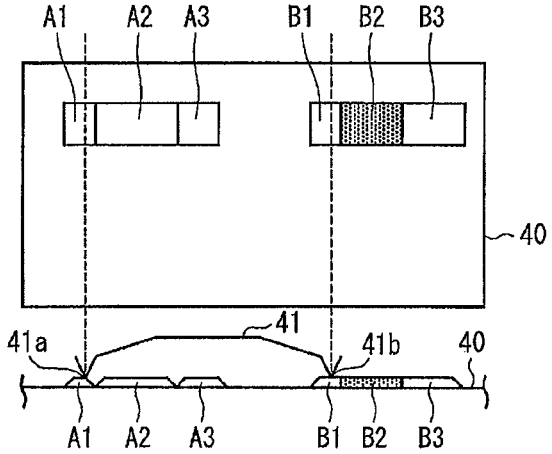
Figure 3:
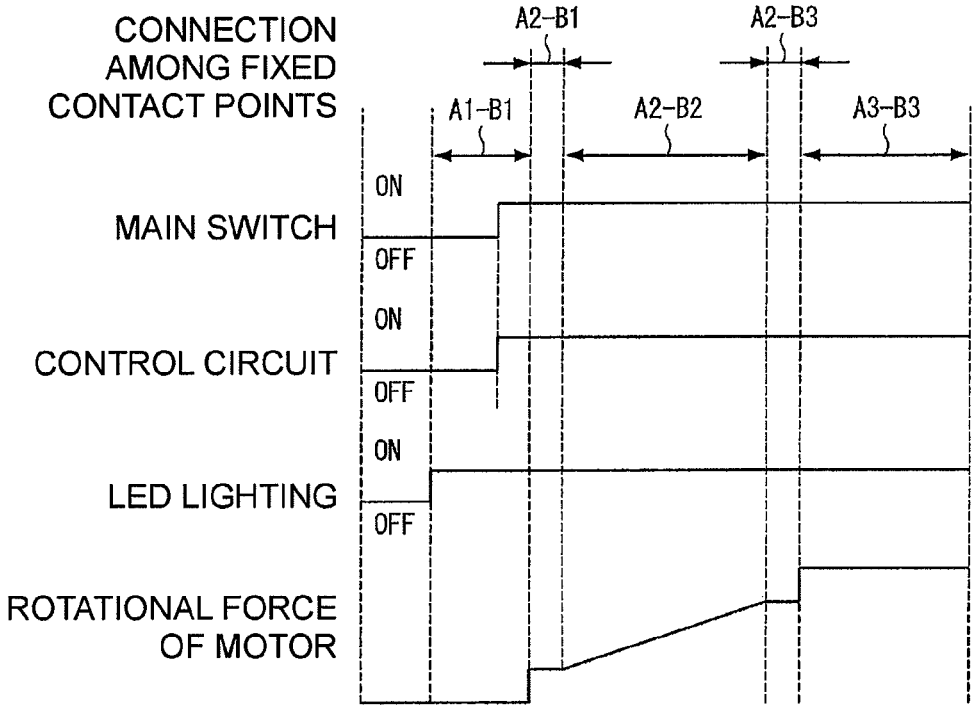
FIG. 3 depicts an embodiment of the operation of the operation of various components of the electric instrument in conjunction with the operation of a trigger.

One embodiment of the present application will be described with reference to FIGS. 1 to 3. FIG. 1 depicts an embodiment of a circuit diagram of an electric instrument comprising a trigger switch circuit.

As shown in FIG. 1, electric instrument 10 comprises a DC power supply E, a motor M and a light-emitting element 15, and a trigger switch circuit 11, which are electrically connected. The DC power supply E is a supply source of DC electric power, the motor M is a mechanical power source, and the light-emitting element 15 is a light source. The light-emitting element 15 may be disposed on a surface of the electric instrument 10 for illumination.

In some embodiments, the DC power supply E is a battery incorporated in the electric instrument 10. In some embodiments, the DC power supply E is a rectified external commercial AC power supply. In some embodiments, light-emitting element 15 is a light-emitting diode (LED). In some embodiments, light-emitting element 15 is a light source such as a halogen lamp, a fluorescent lamp, an incandescent lamp, or other similar light-emitting element.

The trigger switch circuit 11 controls on/off operation of the motor M in conjunction with the operation of a trigger, configured to control the same. The trigger switch circuit 11 also controls on/off operation of the light-emitting element 15. The trigger switch circuit 11 comprises a main switch (power switch) SW1, rotation changeover switches SW2*a* and 2*b*, a brake switch SW3, a switching element 21, a circulation diode D1, and a board portion 22, which may comprise various circuits provided on a circuit board.

The main switch SW1 turns on and off the supply of electric power from the DC power supply E to the motor M and the trigger switch circuit 11. The rotation changeover switches SW2*a* and 2*b* are connected to the motor M to switch between positive rotation and negative rotation of the motor M. The brake switch SW3 is connected to rotation changeover switches SW2*a* and 2*b* to turn on/off the short-circuit of the motor M. Short-circuiting the motor M causes a back electromotive force in the motor M, which applies a brake to stop the motor M.

The switching element 21 is provided between the motor M and the power supply E to rapidly turn on and off the electric power supplied to the motor M, based on pulsing instructions received from the board portion 22. Thereby, the rotational speed of the motor M is controlled by the board portion 22. As the switching element 21, a Field-Effect Transistor (FET) or the like may be used.

In some embodiments, the board portion 22 comprises a rotation control unit 31 that controls operation of the switching element 21 to control the rotational speed of the motor M. In some embodiments, the board portion 22 comprises a light-emission control circuit 32 that controls the light emission of the light-emitting element 15. In some embodiments, the board portion 22 comprises and a changeover switch, or sliding switch SW4.

Sliding switch SW4 comprises a movable body which slides in conjunction with the operation of the above-described trigger. The trigger is operably coupled to sliding switch SW4 such that, as the trigger is operated, sliding switch SW4 slides or moves, making contact with particular contacts as sliding switch SW4 slides or moves. For example, as the trigger operates, the fixed contact points with which a movable contact point 41*a* or 41*b* of the movable body 41 of sliding switch SW4 comes into contact are sequentially changed. FIGS. 2A-2C depict a plan view and a cross-sectional view showing a structure of an embodiment of the sliding switch SW4. As shown in the figures, in the sliding switch SW4, fixed contact points A1-A3 and B1-B3 are provided on a board 40. Sliding switch SW4 comprises movable body 41, which is configured to slide and variously make contact with the fixed contact points A1-A3 and B1-B3. The movable body 41 is in a state as depicted in FIG. 2A at an initial position, and as the movable body 41 moves from the initial position, it is put into a state of FIG. 2B, and then into a state of FIG. 2C. Moveable body 41 is operably coupled to the trigger, such that as the trigger moves from one position to another, moveable body 41 moves from one position to another.

As shown in FIGS. 2A through 2C, the fixed contact points A1-A3 on one side, and the fixed contact points B1 to B3 on the other side are provided in alignment, spaced from each other. The fixed contact points A1, A2, A3 and B1, B2, B3 are provided sequentially from the initial position of the movable body 41. Moreover, as shown in FIG. 1, the fixed contact point B2 functions as a resistor, and the fixed contact points A1-A3, B1, B3 are conductors. As depicted in the circuit diagram of FIG. 1, the fixed contact points A1 to A3 are slightly spaced from one another so that they are immediately switched and are not electrically connected to one another. In some embodiments, the fixed contact points B1 to B3 are in electrical contact with one another.

Referring back to FIG. 1, in the sliding switch SW4, the fixed contact points B1 to B3 are connected in series, and further, the fixed contact point B1 is connected to the power supply E, and the fixed contact point B3 is connected to the main switch SW1. The first contact point A1 is connected to the rotation control unit 31 and the light emission control circuit 32, and the second contact point A2 and the third contact point A3 are connected to the rotation control unit 31.

In some embodiments, the rotation control unit 31 comprises a switching element 51, a control circuit 52, a differential amplifier 53, and various resistances.

In some embodiments, the switching element 51 is an NPN transistor. A collector of the switching element 51 is connected to a power-supply voltage terminal Vcc through a resistance, and connected to a gate of the switching element 21 through a resistance. An emitter of the switching element 51 is connected to a ground terminal GND.

Accordingly, the switching element 51 is turned on when the base thereof is high (H). When the base of switching element 51 is H, switching element 51 conducts, so that the gate of the switching element 21 becomes low (L), thereby turning off the switching element 21 and interrupting current to the motor M. On the other hand, the switching element 51 is turned off when the base thereof is L, which causes the gate of the switching element 21 to be H, thereby turning on the switching element 21 to allow current to flow in the motor M and generate a rotational force (torque).

The base of the switching element 51 is connected to the control circuit 52 through a resistance and a differential amplifier 53. Accordingly, based on a pulse signal output by the control circuit 52 and amplified by the differential amplifier 53, the switching element 51 is rapidly turned on/off, so that the generation of the rotational force of the motor M is rapidly turned on/off.

The control circuit 52 is connected to the fixed contact point A1 of the sliding switch SW4, and when a potential at the fixed contact point A1 is H, the control circuit 52 stops the output of the above-described pulse signal. This stops operation of the rotation control unit 31, and also stops the drive of the motor M.

Moreover, the control circuit 52 is connected to the second contact point A2 of the sliding switch SW4 to change a duty ratio of the above-described pulse signal (ratio of pulse width to one period), based on the potential at the second contact point A2. Accordingly, when the movable body 41 slides and a movable contact point 41*a* is connected to the second contact point A2, a potential at the second contact point A2 is changed in as movable contact point 41*b* is connected to the fixed contact point B2, thereby changing the duty ratio of the above-described pulse signal. Changing the duty ratio of the pulse signal changes the average power supplied to the motor M, which changes the rotational speed of the motor M. Furthermore, the control circuit 52 feeds back a drain voltage of the switching element 21, which can stabilize the rotation control of the motor M.

The base of the switching element 51 is connected to the third contact point A3 of the sliding switch SW4. Accordingly, when the movable body 41 slides, thereby bringing the third contact point A3, and fixed contact point B3 into electrical contact with each other, the base of the switching element 51 is at L. Accordingly, the switching element 51 is put into an off-state, and the switching element 21 is put into an on-state (corresponding to a duty ratio of 100%), which allows the rotational force to be constantly generated in the motor. M, so that the motor M rotates at a high speed.

In some embodiments, the light emission control circuit 32 includes switching elements 61 and 62, an afterglow capacitor 63, and various resistances.

In some embodiments, the switching element 61 is a PNP transistor. An emitter of the switching element 61 is connected to a positive electrode terminal of the power supply E through the light-emitting element 15. A collector of the switching element 61 is connected to a negative electrode terminal of the power supply E without interposing the main switch SW1. Accordingly, when a base of the switching element 61 is L, the switching element 61 is turned on, which allows a current to flow in the light-emitting element 15, thereby causing the light-emitting element 15 to emit light. On the other hand, when the base of the switching element 61 is at H, the switching element 61 is turned off, which stops the current in the light-emitting element 15, thereby stopping the light emission.

In some embodiments, the switching element 62 is an NPN transistor. A collector of the switching element 62 is connected to the base of the switching element 61, and is connected to the emitter of the switching element 61 through a resistance. An emitter of the switching element 62 is connected to the collector of the switching element 61.

Accordingly, the switching element 62 is turned on when its base is at an H level, by which the gate of the switching element 61 is placed at the L level, thereby turning on the switching element 61 and causing the light-emitting element 15 to emit light. In some embodiments, when the base of the switching element 62 is at the L level, the switching element 62 is turned off, by which the gate of the switching element 61 is placed at the H level, thereby turning off the switching element 61, and causing the light-emitting element 15 to stop emitting light.

The first side of the afterglow capacitor 63 is connected to the base of the switching element 62, and the second side thereof is connected to the emitter of the switching element 62. The base of the switching element 62 and the first end of the afterglow capacitor 63 are connected to the first contact point A1 of the sliding switch SW4.

Accordingly, when the movable body 41 of the sliding switch SW4 slides from an initial position into a first position, first contact point A1 and fixed contact point B1 are moved into electrical contact with each other, the base of the switching element 62 is placed at an H level, so that the switching element 62 is turned on. As switching element 62 is turned on, switching element 61 is turned on, providing current flow to light-emitting element 15, and causing the light-emitting element 15 to emit light. At this time, the afterglow capacitor 63 is charged.

In some embodiments, when the movable body 41 of the sliding switch SW4 slides from a first position to another position, so that the first contact points A1 and fixed contact point B1 are disconnected, the afterglow capacitor 63 discharges. Thus, the switching element 62 is maintained in the on-state for a while, using the stored potential from afterglow capacitor 63 and, as the stored potential goes to zero, switching element 62 is then turned off. This allows the light-emitting element 15 to emit light for a while after the trigger is released. As a result, an afterglow effect of emitting light for a while after the first contact point A1 and fixed contact point B1 are disconnected can be obtained, which increases the convenience of the user.

In some embodiments, the main switch SW1 is connected between the base and the collector of the switching element 61. Accordingly, when the main switch SW1 is turned on, the switching element 61 is turned on and the light-emitting element 15 emits the light regardless of a state of the switching element 62, the connection state between the first contact points A1 and fixed contact point B1, or the state of the afterglow capacitor 63.

Operation of some embodiments of the electric instrument 10 as disclosed herein is described. FIG. 3 depicts an embodiment of the operation of various components of the electric instrument in conjunction with the operation of a trigger. FIG. 3 shows the connection relationships between the fixed contact points of the sliding switch SW4, the main switch SW1, the control circuit 52, the light-emitting element 15, the state of the trigger, and the rotational force of the motor M.

When the trigger is not pulled, the trigger is at an initial position, and the movable body 41 of the sliding switch SW4 is at the initial position as shown in FIG. 2A. In this initial position, the movable body 41 is not connected to any of the fixed contact points A1 to A3 or B1 to B3, the main switch SW1 is off, and the brake switch SW3 is on. Accordingly, the control circuit 52 is off, the light-emitting element 15 is not emitting light, and the motor M is not operating.

When the trigger is pulled to reach a first position, the brake switch SW3 is turned off, thereby enabling the motor M to rotate, the movable body 41 of the sliding switch SW4 slides in conjunction with the trigger to reach the position shown in FIG. 2B.

At this time, the first contact point A1 and fixed contact B1 are brought into electrical connection with each other via sliding switch SW4, electric power is supplied to the light emission control circuit 32, thereby causing the light-emitting element 15 to emit light. With the trigger and sliding switch SW4 in the first position, the main switch SW1 is off, and electric power is not supplied to the circuits other than the light emission control circuit 32. Accordingly, light emission occurs without operating the motor circuitry, and wasteful power consumption is suppressed. When the trigger is further pulled to reach a second position, the movable body 41 of the sliding switch SW4 reaches a second position as shown in FIG. 2C. At this time, the main switch SW1 is turned on in conjunction with the trigger, supplying electrical power to the control circuit 52 and the differential amplifier 53. With sliding switch SW4 in the second position, as shown in FIG. 3, the first contact point A1 and fixed contact point B1 are electrically connected with each other, and the output of the pulse signal from the control circuit 52 is stopped, and the motor M does not rotate.

When the trigger is further moved to reach a third position, the movable body 41 of the sliding switch SW4 slides, so that movable contact points 41*a* and 41*b* are switched, providing a connection between the first contact point A1 and fixed contact point B1, to provide a connection between the second contact point A2 and fixed contact point B1. Thus, the potential at the second contact point A2 is at H, or the level of the power-supply voltage Vcc, so that the control circuit 52 starts the output of the pulse signal, and the motor M starts to rotate. With the trigger and the sliding switch SW4 in a third position, although the supply of electric power from the fixed contact point A1 is stopped, the electric power by the main switch SW1 is provided, and thus the light emission of the light-emitting element 15 is maintained.

When the trigger is further moved into a fourth position, the movable body 41 of the sliding switch SW4 slides to a fourth position, so that the connection of movable contact points 41*a* and 41*b* is switched from providing a connection between the second contact points A2 and fixed contact point B1 to provide a connection between the second contact point A2 and fixed contact point B2. This decreases the potential at the second contact point A2 in accordance with the sliding of the movable body 41 of the sliding switch SW4, and the rotational speed of the motor M increases.

When the trigger is further pulled into a fifth position, the movable body 41 of the sliding switch SW4 slides to a position so that the connection of movable contact points 41*a* and 41*b* is switched from providing a connection between the second contact point A2 and fixed contact point B2, to provide a connection between the second contact point A2 and fixed contact point B3. This stops the decrease of the potential at the second contact point A2, and stops the increase of the rotational speed of the motor M.

When the trigger is further pulled to reach a final position, the sliding switch SW4 slides so that the connection of movable contact points 41*a* and 41*b* is switched from providing a connection between the second contact point A2 and fixed contact point B3 to provide a connection between the third contact point A3 and fixed contact point B3. This brings the switching element 21 into a constant on-state regardless of the operation of the control circuit 52, and the rotational speed of the motor M is at its highest level.

The above-described operation of the trigger and sliding switch SW4 is reversible, when the trigger is returned, reverse operation to the above-described operation occurs. In some embodiments, as the trigger is released and returns to an initial position, the light emission of the light-emitting element 15 continues to emit the light using stored potential from the afterglow capacitor 63 for a time.

As described herein, in some embodiments, the trigger switch circuit 11, by utilizing a main switch SW1 and a sliding switch SW4, realizes efficient power supply to and operation of the light emission control circuit 32, and the rotation control unit 31. Accordingly, in some embodiments, the number of switches is not increased, therefore wasteful power consumption is be suppressed without increasing the number of components in the electrical instrument 10.

It will be apparent to a person of skill in the art that the disclosure herein is not limited to the above-described embodiments, and various modifications can be made without departing from the scope of this disclosure.

For example, in some embodiments, the main switch SW1 may be provided on the positive electrode side of the power supply E. In this case, the type of the switching elements 61, 62 of the light emission control circuit 32 may be modified between PNP and NPN, or any other suitable transistor type, as needed.

In some embodiments, the duty ratio of the pulse signal from the control circuit 52 may changed to thereby change the average electric power supplied to the motor M. In some embodiments, the current flowing in the motor M may be changed. In this case, in order to maximize the average electric power supplied to the motor M, the current flowing in the motor M may be maximized.

The foregoing description details certain embodiments of the invention. It will be appreciated, however, that no matter how detailed the foregoing appears in text, the invention may be practiced in many ways. It should be noted that the use of particular terminology when describing certain features or aspects of the invention should not be taken to imply that the terminology is being re-defined herein to be restricted to including any specific characteristics of the features or aspects of the invention with which that terminology is associated.

While the above detailed description has shown, described, and pointed out novel features of the invention as applied to various embodiments, it will be understood that various omissions, substitutions, and changes in the form and details of the device or process illustrated may be made by those skilled in the technology without departing from the spirit of the invention. The scope of the invention is indicated by the appended claims rather than by the foregoing description. All changes which come within the meaning and range of equivalency of the claims are to be embraced within their scope.

What is claimed is:

1. A trigger switch circuit in an electric instrument, comprising:

a trigger having one or more positions;

a power switch configured to control a supply of electric power from a power supply in conjunction with the trigger;

a light-emission circuit comprising a light-emitting element;

a motor connected to a motor control circuit; and a changeover switch operably coupled to the trigger, the changeover switch configured to sequentially switch contact between one or more contact points in conjunction with operation of the trigger, wherein the changeover switch comprises a first contact point that supplies the electric power from the power supply to the light-emission circuit without interposing the power switch and a second contact point connected to the motor control circuit, and wherein the power switch is coupled to control a supply of electric power, in conjunction with the trigger, from the power supply to the motor control circuit.

2. The trigger switch circuit of claim 1, wherein the trigger switch circuit is configured such that:

when the trigger is at an initial position, the power switch is off, and the changeover switch is not connected to either the first or second contact point;

when the trigger moves from the initial position to a first position, the changeover switch moves and is connected to the first contact point, when the trigger moves from the first position to a second position, the power switch is turned on; and when the trigger moves from the second position to a third position, the changeover switch moves, switching connection from the first contact point to the second contact point.

3. The trigger switch circuit of claim 2, wherein the changeover switch further comprises a third contact point that is configured to operate the motor control circuit so as to maximize the average electric power supplied to the motor, wherein the changeover switch is configured to make contact with the third contact point as the trigger moves from the third position to the fourth position.

4. The trigger switch circuit of claim 1, wherein the first contact point of the changeover switch is configured to stop operation of the motor control circuit.

5. The trigger switch circuit of claim 1, wherein the motor control circuit comprises a rotation control unit configured to control average electric power supplied to the motor, and wherein the second contact point of the changeover switch is configured to operate the motor control circuit, so that as the trigger moves from the third position to a fourth position, the average electric power supplied to the motor is increased.

6. The trigger switch circuit of claim 1, wherein the light-emission circuit further comprises an afterglow capacitor that is charged when the electric power from the power supply is supplied, and is discharged to the light-emitting element when the supply of electric power from the power supply to the light-emission circuit is stopped.

7. A method of operating a trigger switch device comprising:

providing the trigger switch circuit of claim 1;

moving the trigger from a first position to a second position, thereby operating the changeover switch to cause illumination by the light emitting element and maintaining the motor circuit de-energized; and moving the trigger from a second position to a third position, thereby further operating the changeover switch to cause energization of the motor circuit, initiating operation of the motor and maintaining illumination of the light emitting element.

8. The method of claim 7 further comprising moving the trigger from a second position to a third position, thereby operating the changeover switch to cause motor speed to increase and to maintain illumination of the light emitting element.

9. An electric instrument comprising:

a motor powered by a power supply, a motor control unit configured to control speed of the motor;

a light-emitting element; and a trigger switch device that is configured to control drive of the motor and light emission of the light-emitting element in conjunction with a trigger, wherein the trigger switch device comprises:

a first contact point electrically connected to the light emitting element and the power supply; and a second contact point electrically connected to the motor control unit wherein the trigger switch device is configured to move such that the trigger switch device makes contact with only one of the first contact point or the second contact point at a time.

* * * * *